US006411488B1

(12) United States Patent
Nishiwaki

(10) Patent No.: US 6,411,488 B1
(45) Date of Patent: Jun. 25, 2002

(54) ON BOARD CURRENT CONTROL DEVICE

(75) Inventor: Fumihiko Nishiwaki, Kobe (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 42 days.

(21) Appl. No.: 09/613,308

(22) Filed: Jul. 10, 2000

(30) Foreign Application Priority Data

Mar. 9, 2000 (JP) ..... 2000-064426

(51) Int. Cl.[7] ..... H01H 47/00
(52) U.S. Cl. ..... 361/160; 361/58; 361/154
(58) Field of Search ..... 361/160, 115, 361/58, 154

(56) References Cited

U.S. PATENT DOCUMENTS 5,416,665 A * 5/1995 Nishiwaki et al. ..... 361/154
5,647,387 A 7/1997 Tsutsui ..... 137/1
5,933,313 A * 8/1999 Furukawa ..... 361/154

FOREIGN PATENT DOCUMENTS

GB 2 257 486 1/1993 ..... F16D/27/16
JP 4-362321 12/1992
JP 2-0737449 1/1998 ..... F16D/27/16
JP 11-40028 2/1999 ..... H01H/47/00

* cited by examiner

*Primary Examiner*—Stephen W. Jackson
(74) *Attorney, Agent, or Firm*—Sughrue Mion, PLLC

(57) ABSTRACT

An on-board current control device comprising: a processing unit 1 operating a current command value from engine control information and driving control information, outputting a current basic pulse width modulating signal, and outputting a current adjusting pulse width modulating signal from current adjusting information; a current regulator 60 modulating the current basic pulse width modulating signal by the current adjusting pulse width modulating signal and generating a current command pulse width modulating signal; a smoothing filter 14 converting the current command pulse width modulating signal to a current command signal like a direct current; a comparator comparing the current command signal like the direct current with a current feed-back signal and outputting a signal corresponding to thus obtained deviation; an output transistor controlling a current value to a load by an output from the comparator; and a current detecting means 46 detecting the load current and generating the current feed-back signal, whereby dispersion of characteristics caused by dispersion of components can be easily corrected.

9 Claims, 6 Drawing Sheets

ON BOARD CURRENT CONTROL DEVICE

BACKGROUND OF THE INVENTION

1. Field of the Invention

The present invention relates to an on-board current control device controlling an inductive load such as an electromagnetic powder clutch, an electromagnetic valve controlling an oil pressure, and so on, which are equipped in a vehicle.

In particular, the present invention relates to improvement of controllability and productivity of the on-board current control device.

2. Discussion of Background

FIG. 6 is a circuit diagram illustrating a structure of a conventional on-board current control device, for example, disclosed in Japanese Patent No. 2737449. FIG. 7 is a chart illustrating a waveform for explaining an operation of the conventional on-board current control device. In FIG. 6, numerical reference 1 designates a processing unit including a microcomputer and so on, inputting engine control information SE and driving control formation SD, and making a PWM modulator 1*a* output a current basic pulse width modulating signal S1. Numerical reference 10 designates a D/A converter including a buffer amplifier 11 for a digital signal, a smoothing filter 14 having a resistance 12 and a capacitor 13, and an analog buffer amplifier 15, wherein the current basic pulse width modulating signal S1 is inputted in the butter amplifier 11 for digital signals in the D/A converter 10 so that a waveform thereof is modified. A high frequency component of the signal is removed by the smoothing filter 14. Thus obtained signal is applied to an input terminal (+) of the analog buffer amplifier 15, and a current command signal Is is outputted from an output terminal of the analog buffer amplifier 15.

Numerical reference 21 designates a comparator outputting an on/off signal to a transistor in a later stage from a deviation between the current command signal Is and a current feed-back signal IF, to be inputted as described below. Numerical reference 22 designates a resistance connecting the comparator 21 to a power source. Numerical reference 23 designates a transistor for converting signals. Numerical reference 24 designates an output transistor. A base of the transistor 23, converting signals, receives the on/off signal from the comparator 21 through series resistances 25 and a resistance 26 connected to an earth. A collector of the transistor 23 is connected to a base of the output transistor 24 through a resistance 27, and an emitter of the transistor 23 is grounded. The base of the output transistor 24 is connected to a power source through a resistance 28, and an emitter of the output transistor 24 is connected to the power source. The on/off signal from the comparator 21 makes the signal-converting transistor 23 turn on or turn off, whereby the output transistor 24 is turned on or turned off along with the turning-on and turning-off of the signal converting transistor 23.

A collector of the output transistor 24 is connected to the earth through a circulating diode 31 and simultaneously connected to an output terminal 32. An exciting coil 35 of an electromagnetic clutch 34, as a load, is connected between the output terminal 32 and another output terminal 33 through slip rings 36 and 37. A load current Ic is applied to the exciting coil 35 depending on the turning-on and the turning-off of the output transistor 24 and a turning-on of a quick-break transistor 41, to be described below, whereby a current value of the load current Ic is controlled by the output transistor 24.

A collector of the quick-break transistor 41 is connected to the output terminal 33. A constant-voltage diode 42 is connected between the collector and a base of the quick-break transistor 41, and an emitter of the constant-voltage diode 42 is grounded through a current detecting resistance 43. Both ends of the current detecting resistance 43 are respectively connected to an input terminal (+) and an input terminal (−) of a current detecting amplifier 46 respectively through a resistance 44 and a parallel circuit having a resistance 45 and an adjusting resistance 45*a*. Further, a feedback resistance 47 is connected between the input terminal (−) of the current detecting amplifier 46 and an output terminal of the current detecting amplifier 46. The current detecting amplifier 46 outputs and supplies the current feedback signal IF, corresponding to the load current Ic, to an input terminal (−) of the above-mentioned comparator 21.

Numerical references 51 and 52 designate signal converting transistors for turning on and turning off the quick-break transistor 41 depending on the signal from the processing unit 1. A base of the signal converting transistor 51 receives a signal from the processing unit 1 through series resistances 53 and a resistance 54 connected to the earth, a collector of the signal converting transistor 51 is connected to a power source through resistances 55 and 56. A base of the signal converting transistor 52 is connected to a connecting point between the resistances 55 and 56, an emitter of the signal converting transistor 52 is connected to the power source, and a collector of the signal converting transistor 52 is connected to the base of the quick-break transistor through a resistance 57. When the signal from the processing unit 1 is a positive potential, the signal converting transistors 51 and 52 are turned on, and the quick-break transistor 41 is turned on; and when the signal is changed to 0, the signal converting transistors 51 and 52 are turned off, and the quick-break transistor 41 is turned off.

In thus constructed conventional on-board current control device, when the engine control information SE and the driving control information SD are inputted into the processing unit 1, the processing unit 1 operates a current command value from the two types of the information SE and SD, modulates the current command value to obtain a PWM modulating signal, and outputs the current basic pulse width modulating signal S1. This current basic pulse width modulating signal S1 is a rectangular wave signal having a weight of modulation in proportional to the current command value illustrated in FIG. 7*a*. However, because a voltage value is not an ideal waveform, being in a range of 0 through V5 of a voltage of the power source, because of a voltage drop inside a circuit. Therefore, the current basic pulse width modulating signal is converted to a pulse width modulating signal S2 having an ideal waveform illustrated in FIG. 5*b* by the buffer amplifier 11 for digital signals.

A high frequency component of the pulse width modulating signal S2 is removed by the smoothing filter 14 to be converted to a signal like a direct current. Thereafter, the pulse width modulating signal S2 is applied to the analog buffer amplifier 15. The analog buffer amplifier 15 outputs the current command signal Is illustrated in FIG. 7*c* and applies to the terminal (+) of the comparator 21. Since the current feed-back signal Is is applied from the current detecting amplifier 46 to the terminal (−) of the comparator 21, the current command signal Is and the current feed-back signal IF are compared. Depending on a difference between these, a signal subjected to the pulse width modulation is outputted from the output terminal of the comparator 21 in response to the difference, the signal converting transistor 23 and the output transistor 24 are turned on or turned off in response to a rate of modulation of the signal to control a current value of the load current Ic, passing through an exciting coil 35 of the electromagnetic clutch 34.

Further, when the electromagnetic clutch 34 is actuated, the signal applied from the processing unit 1 to the signal converting transistor 51 as a positive tension. Therefore, the signal converting transistors 51 and 52 are turned on, and accordingly the quick-break transistor 41 is also turned on. The load current Ic controlled by the output transistor 24 is applied to the exciting coil 35 of the electromagnetic clutch 34. the load current Ic flows through the current detecting resistance 43 to cause a potential difference on both ends of the resistance in proportion to the current value. The potential difference is applied to the current detecting amplifier 46 through the resistance 44 and the parallel circuit of the resistance 45 and the adjusting resistance 45*a*. The current feed-back signal IF, determined by resistance values of the feed-back resistance 47, the resistance 44, and the parallel circuit of the resistance 45 and the adjusting resistance 45*a*, is outputted to the comparator 21.

As described, the current Ic controlled by the current command value is applied to the exciting coil 35 of the electromagnetic clutch 34 so as to be actuated. Further, by changing the signal applied from the processing unit 1 to the signal converting transistor 51 to 0, the signal converting transistors 51 and 52 and the quick-break transistor 41 are turned off, whereby the current flowing through the exciting coil 35 is shut off, and the electromagnetic clutch 34 is released to finish an operation.

In the conventional on-board current control device, the current Ic flowing through the exciting coil 35 of the electromagnetic clutch 34 is controlled by the modulating factor of the pulse width modulating signal outputted from the comparator 21, the modulating factor is determined by the current command signal Is and the current feed-back signal IF, and the current feed-back signal IF is determined by resistance values of the feed-back resistance 47, the resistance 44, and the resistance 45. However, there are dispersions in resistance values of the resistances, and there is a dispersion of characteristics in the current detecting amplifier 46. Therefore it is necessary to absorb the dispersions of the components and adjust an amplification factor of the current detecting amplifier 46. Such an operation of adjusting the amplification prevents a flow of a production process, and spoils improvement of a production efficiency, whereby an adjustment using stepwise resistance values of the adjusting resistance 45*a* results in a stepwise adjustment of the load current Ic, and there are a certain limit in controllability.

SUMMARY OF THE INVENTION

It is an object of the present invention to solve the above-mentioned problems inherent in the conventional technique and to provide an on-board current control device facilitating an adjusting operation of adjusting a current supplied to a load, enhancing a production efficiency by abolishing adjusting resistances, and improving a controllability.

According to a first aspect of the present invention, there is provided an on board current control device comprising:

a processing unit outputting a current basic pulse width modulating signal by operating a current command value from engine controlling information and driving control information and outputting a current adjusting pulse width modulating signal from current adjusting information;

a current regulator modulating the current basic pulse width modulating signal by the current adjusting pulse width modulating signal and generating a current command pulse width modulating signal;

a smoothing filter removing a high frequency part of the current command pulse width modulating signal and converting to a current command signal;

a comparator outputting a signal in response to a deviation obtained as a result of a comparison between the current command signal and a current feed-back signal;

an output transistor controlling a current value applied to the load by the output from the comparator; and a current detecting means generating the current feed-back signal by detecting the load current.

According to a second aspect of the present invention, there is provided an on-board current control device, wherein a volatile storage, memorizing the current adjusting information, is formed in the processing unit.

According to a third aspect of the present invention, there is provided an on-board current control device, wherein a nonvolatile storage, to which the current adjusting information is written, is formed in the processing unit.

According to a fourth aspect of the present invention, there is provided an on-board current control device, wherein a load subjected to the current control is an electromagnetic powder clutch.

According to a fifth aspect of the present invention, there is provided an on-board current control device, wherein a load subjected to the current control is an electromagnetic valve controlling an oil pressure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A detailed explanation will be given of preferred embodiments of the present invention in reference to FIGS. 1 through 5 as follows, wherein the same numerical references are used for the same or similar portions and description of these portions is omitted.

EMBODIMENT 1

Figure 1:
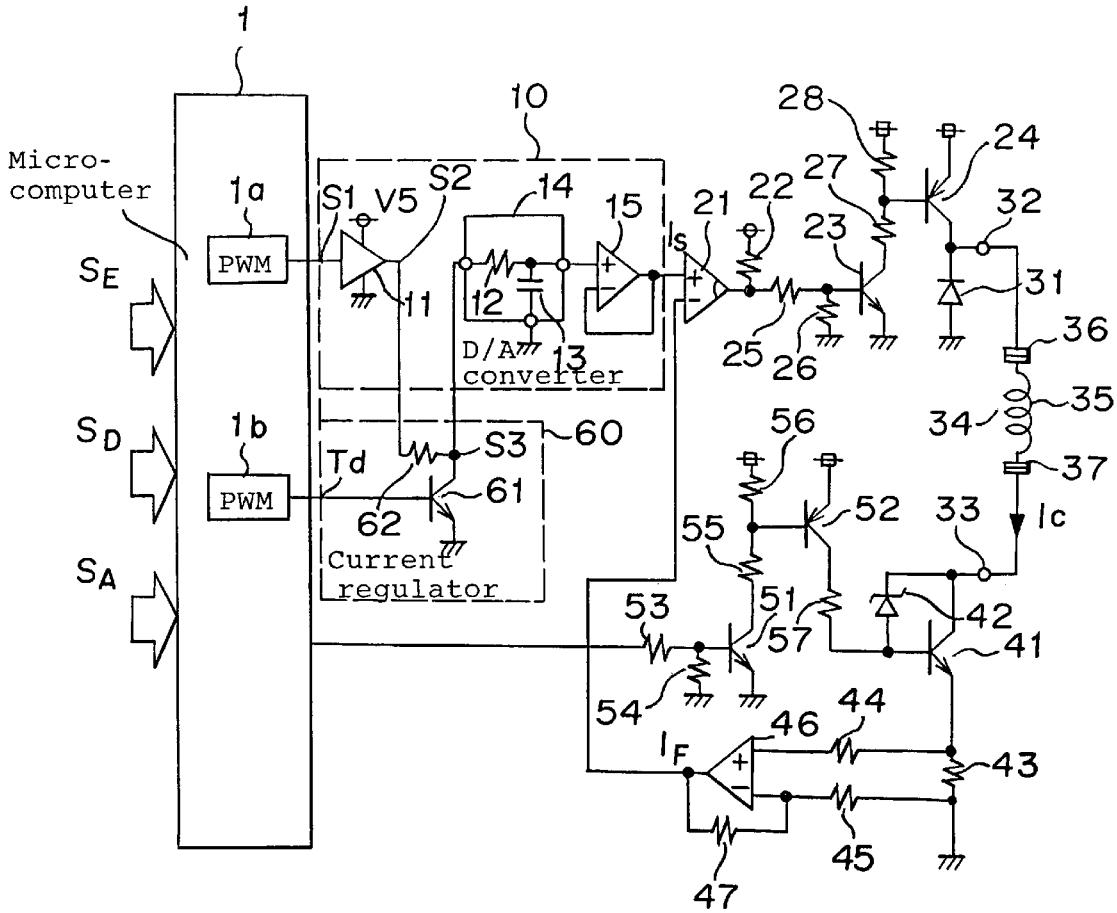
FIG. 1 is a circuit diagram illustrating a structure of an on-board current control device according to Embodiment 1 of the present invention.
Figures 2A, 2B, 2C, 2D, 2E:
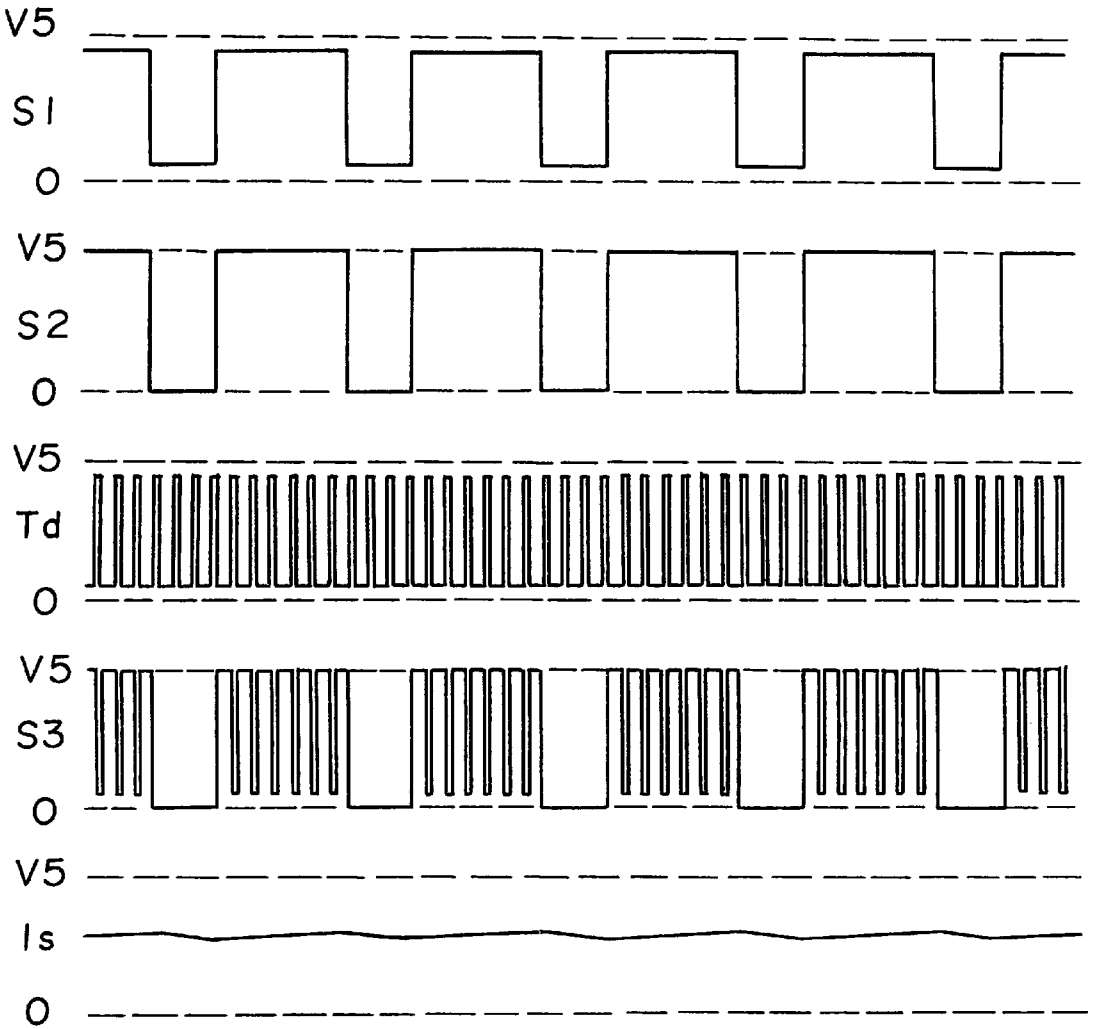
FIG. 2*a* illustrates a waveform of the on-board current control device according to Embodiment 1 for explaining an operation thereof.
FIG. 2*b* illustrates a waveform of the on-board current control device according to Embodiment 1 for explaining the operation thereof.
FIG. 2*c* illustrates a waveform of the on-board current control device according to Embodiment 1 for explaining the operation thereof.
FIG. 2*d* illustrates a waveform of the on-board current control device according to Embodiment 1 for explaining the operation thereof.
FIG. 2*e* illustrates a waveform of the on-board current control device according to Embodiment 1 for explaining the operation thereof.
Figure 3:
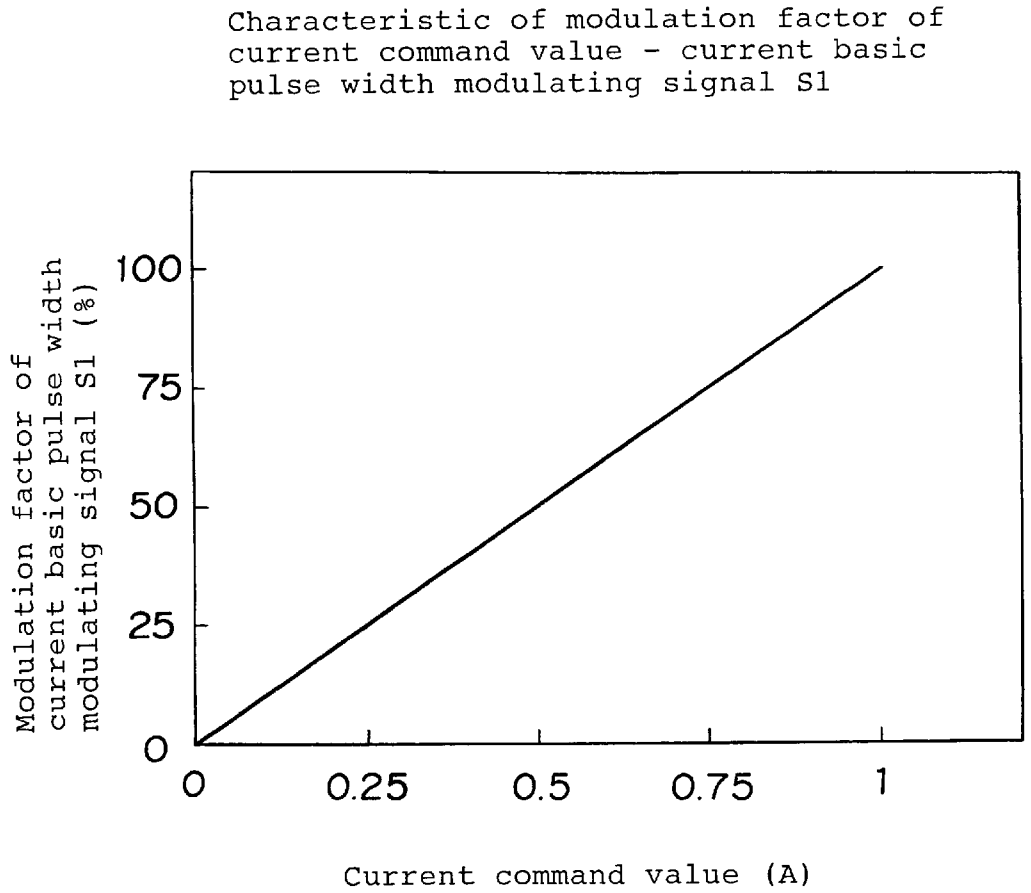
FIG. 3 is a graph showing characteristics of the on-board current control device according to Embodiment 1 for explaining the operation thereof.
Figure 4:
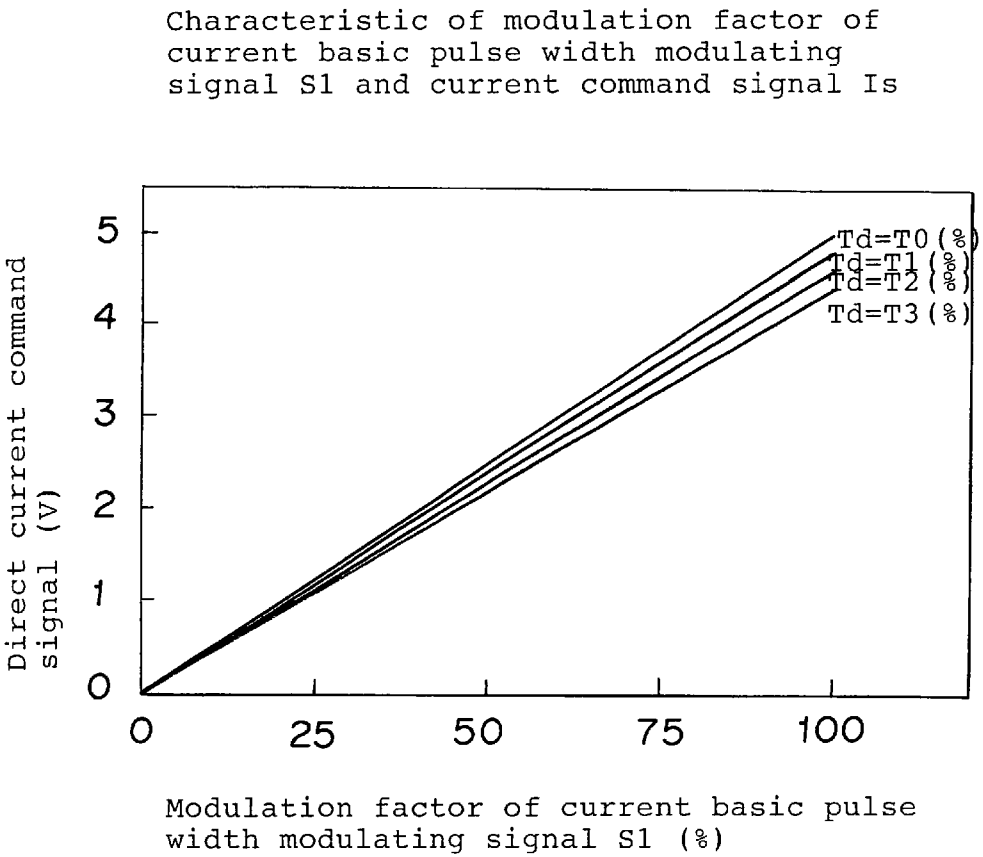
FIG. 4 is a graph showing characteristics of the on-board current control device according to Embodiment 1 for explaining the operation thereof.

FIGS. 1 through 4 illustrate an on-board current control device according to Embodiment 1 of the present invention. FIG. 1 is a circuit diagram illustrating a structure of the on-board current control device. FIGS. 2*a* through 2*e* illustrate waveforms for explaining an operation of the on-board current control device. FIGS. 3 and 4 illustrate characteristics of the onboard current control device for explaining the operation. In the figures, portions having the same function as in conventional technique are referred to by the same numerical references. In FIG. 1, numerical reference 1 designates a processing unit including a microcomputer and so on for receiving engine control information SE, driving control information SD, and current adjusting information SA. The processing unit has a first PWM modulator 1*a*, outputting a current basic pulse width modulating signal S1 based on the engine control information SE and the driving control information SD, and a second PWM modulator 1*b*, outputting a current adjusting pulse width modulating signal Td from the current adjusting information SA.

Numerical reference 10 designates a D/A converter. Numerical reference 60 designates a current regulator. The D/A converter 10 is constructed by a buffer amplifier 11 for digital signals receiving the current basic pulse width modulating signal S1, a smoothing filter 14 including a resistance 12 and a capacitor 13, and an analog buffer amplifier 15, wherein the current regulator 60 is constructed by a current adjusting transistor 61 receiving a current adjusting pulse width modulating signal Td. A pulse width modulating signal S2 outputted from the buffer amplifier for the digital signals is supplied to a collector of the current adjusting transistor 61 through the resistance 62, modulated by the current adjusting transistor 61, applied to the smoothing filter 14, shaped to remove a high-frequency portion, applied to a terminal (+) of the analog buffer amplifier 15, and outputted as a current command signal Is from the analog buffer amplifier.

Numerical reference 21 designates a comparator receiving the current command signal Is outputted from the analog buffer amplifier 15 and a current feed-back signal IF, to be described below. Numerical reference 22 designates a resistance connecting the comparator 21 to a power source. Numerical reference 23 designates a signal converting transistor. Numerical reference 24 designates an output transistor. Numerical reference 25 designates a resistance connected to a base of the signal converting transistor 23 in series. Numerical reference 26 designates a resistance connected between the base of the signal converting transistor 23 and the earth. Numerical reference 27 designates a resistance connected between a collector of the signal converting transistor 23 and a base of the output transistor 24. Numerical reference 28 designates a resistance connecting the base of the output transistor 24 to the power source, wherein a circuit structure from the comparator 21 to the output transistor and an operation are the same as those in the conventional technique. Namely, an on/off signal outputted from the comparator 21 makes the signal converting transistor 23 turn on or turn off. The output transistor is also turned on or turned off by the turning-on and turning-off of the signal converting transistor 23.

Numerical reference 31 designates a circulating diode connected to a collector of the output transistor 24. Numerical references 32 and 33 designate output terminals. Numerical reference 34 designates an electromagnetic clutch formed by interposing an exciting coil 35 between slip rings 36 and 37. Numerical reference 41 designates a quick-break transistor connected to the output terminal 33. Numerical reference 42 designates a constant-voltage diode connected between a collector and a base of the quick-break transistor 41. Numerical references 51 and 52 designate signal converting transistors making the quick-break transistor 41 turn on or turn off by a signal from the processing unit 1. Numerical reference 53 designates a resistance connected to a base of the signal converting transistor 51 in series. Numerical reference 54 designates a resistance, connecting a base of the signal converting transistor 51 to an earth. Numerical reference 55 designates a resistance, connecting a collector of the signal converting transistor 51 to a base of the signal converting transistor 52. Numerical reference 56 designates a resistance, connecting the base of the signal converting transistor 52 to a power source. Numerical reference 57 designates a resistance, connecting a collector of the signal converting transistor 52 to a base of the quick-break transistor 41. The structure according to the present invention is the same as that in the conventional technique.

An emitter of the quick-break transistor 41 is grounded through the current detecting resistance 43. Both ends of the current detecting resistance 43 are connected respectively to an input terminal (+) and input terminal (−) of the current detecting amplifier 46 respectively through resistances 44 and 45, and a feed-back resistance 47 is connected between the input terminal (−) of the current detecting amplifier 46 and an output terminal to form the current detecting means. The current detecting amplifier 46 outputs the current feed-back signal IF in response to a current Ic, flowing through the exciting coil 35 of the electromagnetic clutch 34, and applies to the input terminal (−) of the comparator 21.

In thus constructed on-board current control device according to Embodiment 1 of the present invention, when the engine control information SE, the driving control information SD, and the current adjusting information SA are inputted into the processing unit 1, the processing unit 1 operates the current command value from the engine control information SE and the driving control information SD; the first PWM modulator 1*a* modulates the current command value by a PWM, outputs the current basic pulse width modulating signal S1, operates a current adjusting signal from the current adjusting information SA; and the second PWM modulator 1*b* modulates by a PWM to output the current adjusting pulse width modulating signal Td.

The current basic pulse width modulating signal S1 is a rectangular signal having a modulation factor in proportion to the current command value as illustrated in FIG. 2*a*. In a similar manner to that in the conventional technique, because an ideal waveform covering 0 through V5 of a voltage of the power source is not obtained as a result of a drop of a voltage value inside a circuit, the current basic pulse width modulating signal S1 is converted to the pulse width modulating signal S2 having an ideal waveform illustrated in FIG. 2*b* by a buffer amplifier 11 for digital signals and supplied to the collector of the current adjusting transistor 61. The current adjusting pulse width modulating signal Td is a pulse width modulating signal having a modulation factor, obtained based on the current adjusting information illustrated in FIG. 2*c*. The current adjusting pulse width modulating signal is applied to a base of the current adjusting transistor 61, and turns on and turns off the current adjusting transistor 61 based on this signal.

As a result, the pulse width modulating signal S2 for commanding supply of a current is modulated by the current adjusting pulse width modulating signal Td by turning on and turning off the current adjusting transistor 61 to obtain a current command pulse width modulating signal S3 illustrated in FIG. 2*d*. Thus obtained current command pulse width modulating signal S3 is applied to the smoothing filter 14 so that a high frequency component thereof is removed so as to be converted to a signal like a direct current. Thereafter, it is applied to the analog buffer amplifier 1, amplified to be the current command signal Is illustrated in FIG. 2*e*, and applied to the terminal (+) of the comparator 21. Because the current feed-back signal IF is applied to the terminal (−) of the comparator 21 from the current detecting amplifier 46, the current command signal Is is compared with the current feed-back signal IF, a signal subjected to the pulse width modulation is outputted from an output terminal of the comparator 21 in response to a difference therebetween. Depending on a modulation factor of thus modulated signal, the signal converting transistor 23 and the output transistor 24 are controlled to turn on or turn off, whereby a current flowing through the exciting coil 35 of the electromagnetic clutch 34 is controlled.

The modulation factor of the current basic pulse width modulating signal S1 changes as illustrated in FIG. 3. For example, in case that the maximum value of the current command value is set 1A, a relationship between the modulation factor and the current command value is set like a linear function from 0% to 100% with the modulation factor of 100% corresponding to the maximum value. Further, the relationship between the modulation factor of the current basic pulse width modulating signal S1 and a signal voltage of the current command signal Is becomes like a linear function as a matter of course. As illustrated in FIG. 4, a gradient of the relationship changes depending on the modulation factor of the current adjusting pulse width modulating signal Td. In other words, when the modulation factor of the current adjusting pulse width modulating signal Td is 0%, the current basic pulse width modulation signal S1 has a modulation factor of 100%, and the signal voltage of the current command signal Is is the same as the voltage of the power source of 5V. The voltage of the current command signal Is decreases as the modulation factor of the current adjusting pulse width modulating signal Td increases.

As described, according to the on-board current control device described in Embodiment 1, since the value of the current command signal Is is adjusted by the modulation factor of the current adjusting pulse width modulating signal Td, a dispersion of the current feedback signal IF caused by a dispersion of components of the on-board current control device is corrected by controlling the modulation factor of the current adjusting pulse width modulation signal Td and resultantly changing the value of the current command signal Is. Therefore, it becomes unnecessary to substitute adjusting resistances in a process of production and to provide the adjusting resistances, whereby a load current Ic can be easily and highly accurately adjusted by linearly changing the current adjusting information SA. Although, in the above description, the load to the on-board current control device is the electromagnetic clutch 34, the electromagnetic clutch 34 is ordinarily a powder clutch. The load may be an induction load such as an electromagnetic valve for controlling an oil pressure other than the electromagnetic clutch.

EMBODIMENT 2

Figure 5:
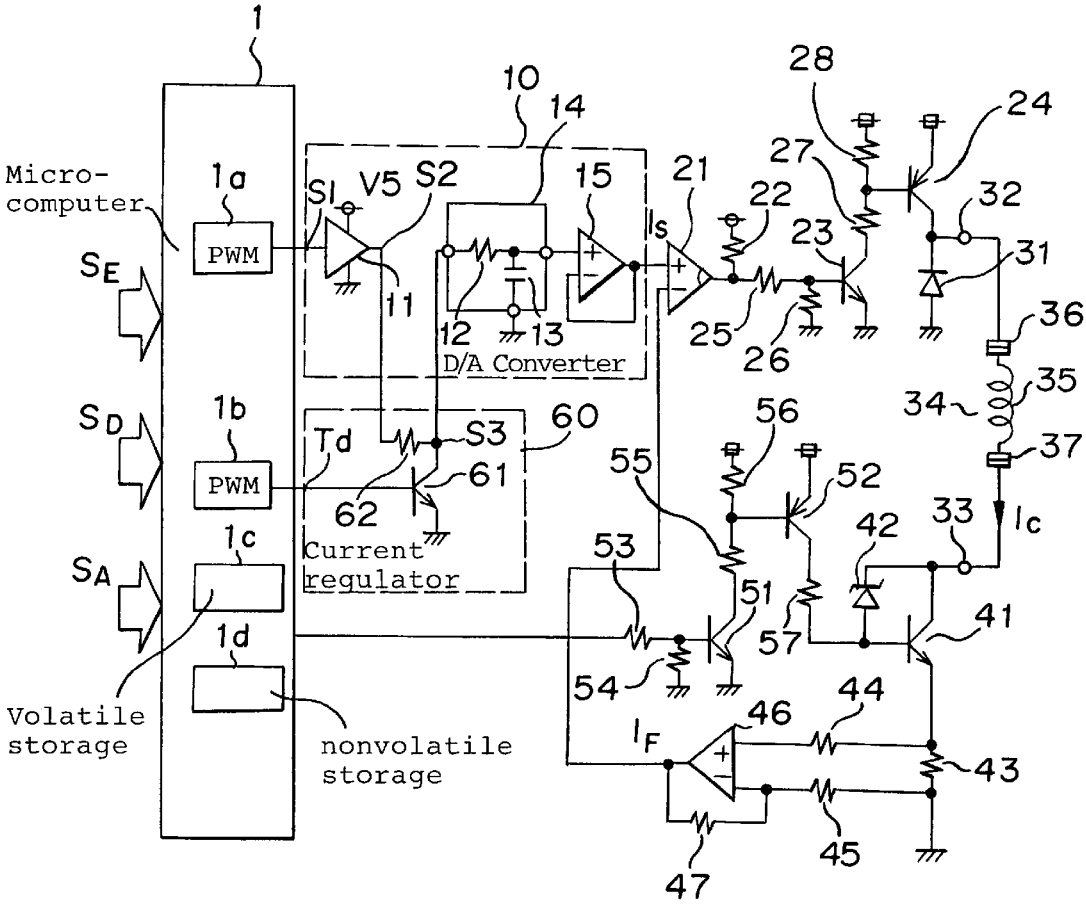
FIG. 5 is a circuit diagram illustrating a structure of the on-board current control device according to Embodiment 1 of the present invention.
Figure 6:
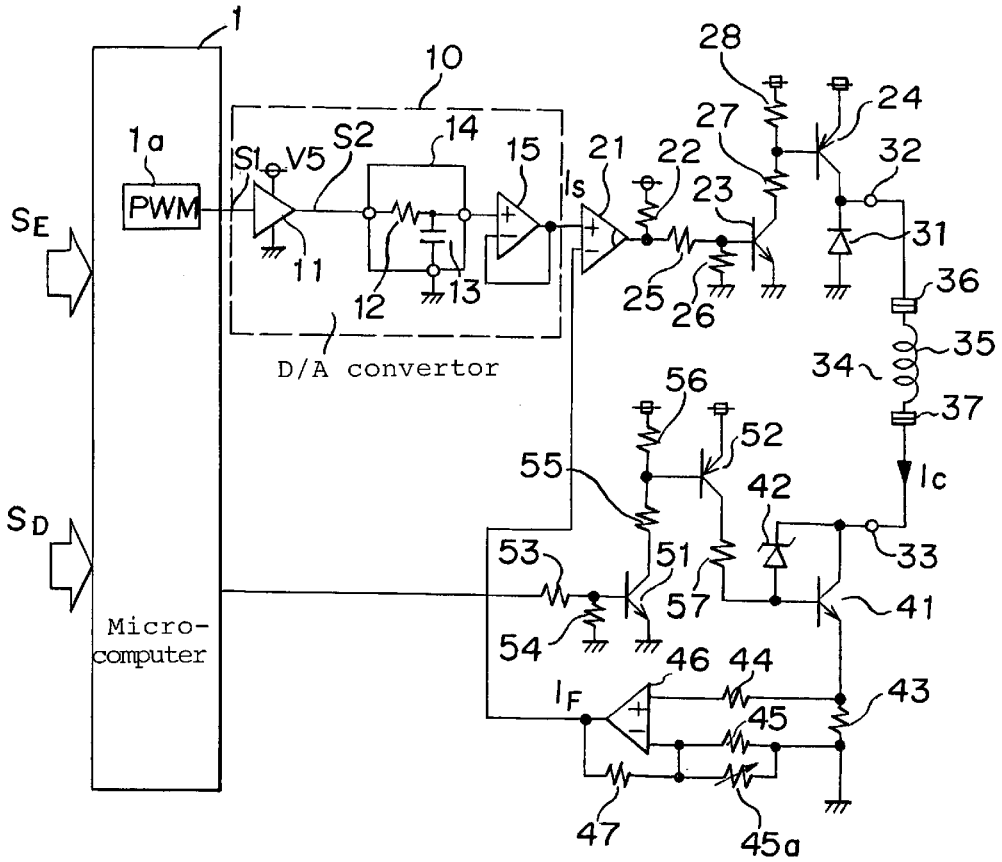
FIG. 6 is a circuit diagram illustrating a structure of a conventional on-board current control device.
Figure 7A:
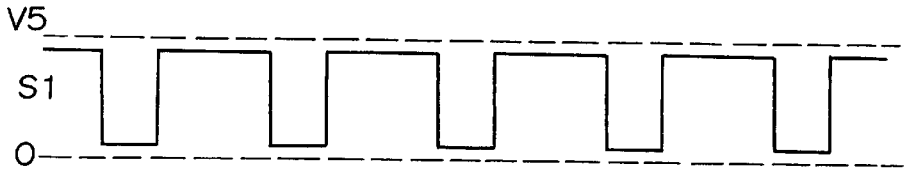
FIG. 7*a* illustrates a waveform of the conventional on-board current control device for explaining an operation thereof.
Figure 7B:
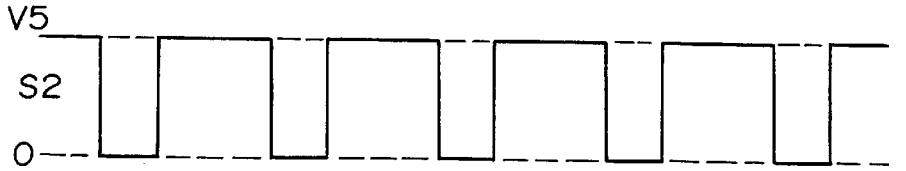
FIG. 7*b* illustrates a waveform of the conventional on-board current control device for explaining the operation thereof.
Figure 7C:
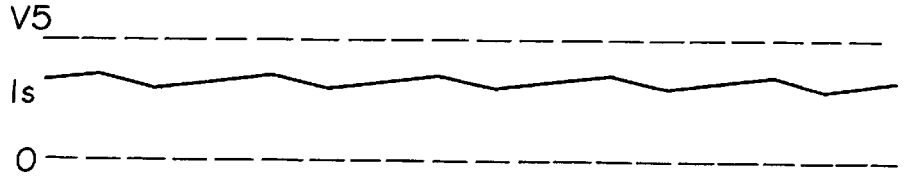
FIG. 7*c* illustrates a waveform of the conventional on-board current control device for explaining the operation thereof.

FIG. 5 is a circuit diagram illustrating a structure of an on-board current control device according to Embodiment 2 of the present invention. In Embodiment 2, a volatile storage 1*c* or a nonvolatile storage 1*d* is located in the processing unit 1 described in Embodiment 1. By constructing as such, the current adjusting information is memorized in the volatile storage 1*c*; it becomes possible to use a back-up function of a microcomputer in the processing unit 1 to make the storage memorize the current adjusting information; and it becomes possible to make the nonvolatile storage Id memorize the current adjusting information, even though a power source of the microcomputer is turned off by previously writing the current adjusting information in the nonvolatile storage 1*d*.

The advantages of the on-board current control device according to the present invention is that a dispersion of characteristics can be absorbed; operations of substituting and adjusting resisters in a process of production are unnecessitated; the current can be controlled with a higher accuracy; and productivity and controllability are excellent.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application No. 2000-064426 filed on Mar. 9, 2000 including specification, claims, drawings and summary are incorporated herein by reference in its entirety.

What is claimed is:

1. An on-board current control device comprising:

a processing unit outputting a current basic pulse width modulating signal by operating a current command value from engine controlling information and driving control information and outputting a current adjusting pulse width modulating signal from current adjusting information;

a current regulator modulating the current basic pulse width modulating signal by the current adjusting pulse width modulating signal and generating a current command pulse width modulating signal;

a smoothing filter removing a high frequency part of the current command pulse width modulating signal and converting to a current command signal;

a comparator outputting a signal in response to a deviation obtained as a result of a comparison between the current command signal and a current feed-back signal;

an output transistor controlling a current value applied to the load by the output from the comparator; and a current detecting means generating the current feed-back signal by detecting the current value applied to the load.

2. The on-board current control device according to claim 1, wherein a volatile storage memorizing the current adjusting information is formed in the processing unit.

3. The on-board current control device according to claim 1, wherein a nonvolatile storage, to which the current adjusting information is written, is formed in the processing unit.

4. The on-board current control device according to claim 1, wherein a load subjected to the current control is an electromagnetic powder clutch.

5. The on-board current control device according to claim 2, wherein a load subjected to the current control is an electromagnetic powder clutch.

6. The on-board current control device according to claim 3, wherein a load subjected to the current control is an electromagnetic powder clutch.

7. The on-board current control device according to claim 1, wherein a load subjected to the current control is an electromagnetic valve for controlling an oil pressure.

8. The on-board current control device according to claim 2, wherein a load subjected to the current control is an electromagnetic valve for controlling an oil pressure.

9. The on-board current control device according to claim 3, wherein a load subjected to the current control is an electromagnetic valve for controlling an oil pressure.

* * * * *